US009355597B2

(12) United States Patent
Yang

(10) Patent No.: US 9,355,597 B2
(45) Date of Patent: May 31, 2016

(54) PIXEL CIRCUIT HAVING THRESHOLD VOLTAGE COMPENSATION AND METHOD FOR DRIVING THE SAME

(71) Applicant: BOE TECHNOLOGY GROUP CO., LTD., Beijing (CN)

(72) Inventor: Fei Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 91 days.

(21) Appl. No.: 14/342,306

(22) PCT Filed: Jul. 26, 2013

(86) PCT No.: PCT/CN2013/080156

§ 371 (c)(1),
(2) Date: Feb. 28, 2014

(87) PCT Pub. No.: WO2014/187026

PCT Pub. Date: Nov. 27, 2014

(65) Prior Publication Data

US 2015/0028766 A1 Jan. 29, 2015

(30) Foreign Application Priority Data

May 21, 2013 (CN) ..... 2013 1 0190350

(51) Int. Cl.
*G09G 3/30* (2006.01)
*G09G 3/32* (2016.01)
*G09G 3/10* (2006.01)

(52) U.S. Cl.
CPC ..... *G09G 3/3291* (2013.01); *G09G 3/3225* (2013.01); *G09G 3/3233* (2013.01); (Continued)

(58) Field of Classification Search
CPC ..... G09G 3/325; G09G 3/3225
USPC ..... 345/76; 315/169.3
See application file for complete search history.

(56) References Cited

U.S. PATENT DOCUMENTS

2004/0251846 A1* 12/2004 Choi et al. ..... 315/169.3
2005/0269959 A1* 12/2005 Uchino et al. ..... 315/169.3

(Continued)

FOREIGN PATENT DOCUMENTS

CN 2033000187 U 11/2013

OTHER PUBLICATIONS

First Office Action (Chinese language) issued by the State Intellectual Property Office ("SIPO") on Sep. 30, 2014 for application No. 201310190350.4, 4 pages.

(Continued)

*Primary Examiner* — Adam J Snyder

(57) ABSTRACT

The present disclosure relates to a field of display technology, and particularly to a pixel circuit and a method for driving the same. The pixel circuit includes a driving sub-circuit, a resetting sub-circuit, and a charging sub-circuit, wherein the driving sub-circuit includes a driving transistor, a first transistor, a third transistor, a first storage capacitor and a second storage capacitor; the resetting sub-circuit discharges the first storage capacitor and the second storage capacitor under the control of a first scan signal outputted from the first scan signal line; and the charging sub-circuit includes a fifth transistor and a sixth transistor. With the pixel circuit of the present disclosure, non-uniformity of driving transistors caused by threshold voltages of the driving transistors and an image sticking phenomenon caused by drifts of the threshold voltages of the driving transistors may be eliminated through the compensation; and the problem of non-uniform luminance among the light emitting devices in different pixel units of an Active Matrix Organic Light Emitting Diode Display caused by different threshold voltages of the driving transistors in the different pixel units may be avoided.

7 Claims, 9 Drawing Sheets

(52) U.S. Cl.
CPC ..... *G09G2300/0809* (2013.01); *G09G 2300/0819* (2013.01); *G09G 2300/0852* (2013.01); *G09G 2300/0861* (2013.01); *G09G 2300/0876* (2013.01); *G09G 2310/0251* (2013.01); *G09G 2320/0233* (2013.01); *G09G 2320/0257* (2013.01); *G09G 2320/043* (2013.01)

(56) References Cited

U.S. PATENT DOCUMENTS

| | | | | |
|---|---|---|---|---|
| 2005/0280614 | A1* | 12/2005 | Goh | 345/76 |
| 2006/0256058 | A1* | 11/2006 | Asano et al. | 345/92 |
| 2007/0001958 | A1* | 1/2007 | Lee et al. | 345/92 |
| 2008/0225061 | A1* | 9/2008 | Kimura et al. | 345/690 |
| 2010/0123700 | A1* | 5/2010 | Kim et al. | 345/76 |
| 2010/0309174 | A1* | 12/2010 | Tomida et al. | 345/204 |
| 2011/0273419 | A1* | 11/2011 | Park et al. | 345/76 |
| 2013/0249875 | A1* | 9/2013 | Tseng et al. | 345/205 |
| 2014/0313235 | A1* | 10/2014 | Park et al. | 345/690 |

OTHER PUBLICATIONS

English translation of first Office Action issued by SIPO for application No. 201310190350.4, 2 pages, Sep. 30, 2014.
International Search Report for International Application No. PCT/CN2013/080156, 15pgs, Feb. 27, 2014.
PCT International Preliminary Report on Patentability for International Application No. PCT/CN2013/080156, dated Nov. 24, 2016; 10pgs.
PCT International Preliminary Report on Patentability for International Application No. PCT/CN2013/080156, dated Nov. 24, 2015; 10pgs.

* cited by examiner

PIXEL CIRCUIT HAVING THRESHOLD VOLTAGE COMPENSATION AND METHOD FOR DRIVING THE SAME

CROSS REFERENCE TO RELATED APPLICATIONS

This application is based on International Application No. PCT/CN2013/080156 filed on Jul. 26, 2013, which claims priority to Chinese National Application No. 201310190350.4 filed on May 21, 2013. The entire contents of each and every foregoing application are incorporated herein by reference.

TECHNICAL FIELD OF THE DISCLOSURE

The present disclosure relates to a field of display technology, and particularly to a pixel circuit and a method for driving the same.

BACKGROUND

Organic light emitting diodes (OLED) have been increasingly used as current-type light-emitting devices in high-performance Active Matrix Organic Light Emitting Diode displays. With increasing of display size, conventional passive matrix organic light emitting diode displays require a shorter driving time for a single pixel, and thus require an increased transient current, which causes increased power consumption. Meanwhile, a voltage drop on a line of nanometer indium tin oxide will be too large when a large current is applied, such that an operating voltage of OLED is too high and efficiency of OLED is decreased. The currents for OLEDs are input to active-matrix organic light-emitting diode displays when switching transistors are scanned progressively, which can solve the above problems well.

In design of an AMOLED backboard, a main problem to be solved is non-uniformity of luminance among compensating circuits for respective pixel units of AMOLED.

First, for AMOLED, pixel circuits are constituted by thin film transistors to supply currents for driving light emitting devices, respectively. In prior art, Low-temperature polysilicon thin film transistors (LTPS TFT) or oxide thin film transistor (Oxide TFT) are mostly adopted. Compared to a general amorphous silicon thin film transistor (amorphous-Si TFT), LTPS TFT and Oxide TFT have higher mobility and more stable characteristics, and thus are more suitable for AMOLED display. However, due to limitations of the crystallization process, LTPS TFTs produced on a large-area glass substrate often have non-uniformity on electrical parameters such as threshold voltage, mobility and the like, and such non-uniformity may cause driving current difference and luminance difference among OLED devices, that is, a mum phenomenon occurs, which may be perceived by human eyes. Although process of Oxide TFTs shows a better uniformity, similar to a-Si TFTs, a threshold voltage of Oxide TFT may drift under a high temperature or supplied with a voltage for a long time. Due to different images as displayed, drifts of threshold voltages of TFTs in respective areas on a panel may be different from each other, which may cause display luminance difference, such a display luminance difference often renders an image sticking phenomenon since such a display luminance difference has a relation to a previously displayed image.

Second, in large-size display applications, since a certain resistance exists in a power supply line on the backboard, and driving currents for all pixels are supplied from an ARVDD power supply, a supply voltage for an area near to a location of the ARVDD power supply is higher than a supply voltage for an area far from the location, such a phenomenon is known as a voltage drop of the power supply (IR Drop). As the voltage of the ARVDD power supply has a relation to currents in different areas, IR drop may also cause driving current difference among different areas, and thus a mum phenomenon appears during display. LTPS process for constructing pixel units by adopting P-type TFTs is sensitive to such an IP drop since a storage capacitor therein is connected between the ARVDD and a gate of TFT, and thus voltage variation of ARVDD may directly affect a gate voltage Vgs of the driving TFT.

Third, the non-uniformity of the electrical characteristics of the light-emitting devices may also be resulted from non-uniform thickness of the mask during an evaporation process. For the a-Si or Oxide TFT process constructing pixel units by adopting N-type TFTs, a storage capacitor therein is connected between a gate of the driving TFT and an anode of the light-emitting device, if voltages at the first terminals of the light-emitting devices of respective pixels are different when a data voltage is transmitted to the gates, voltages Vgs actually applied to the gates of TFTs may be different, so that display luminance are different due to different driving currents.

Therefore, in order to solve the above problems, there is a need for a pixel circuit and a method for driving the same.

SUMMARY

In embodiments of the present disclosure, there are provided a pixel circuit and a method for driving the same, capable of solving a problem of non-uniformity of threshold voltages of driving transistors when compensation is performed in the pixel circuit in the prior art.

The embodiments of the present disclosure are implemented with the following technical solutions.

There is provided a pixel circuit including a resetting sub-circuit, a charging sub-circuit, a driving sub-circuit and a light emitting device, wherein a first terminal of the light emitting device is connected to a second voltage terminal;

the driving sub-circuit includes a driving transistor, a first transistor, a third transistor, a first storage capacitor and a second storage capacitor, a source of the driving transistor is connected to a drain of the first transistor and a source of the third transistor, a drain of the driving transistor is connected to a second terminal of the light emitting device, a gate of the driving transistor is connected to a first terminal of the first storage capacitor; a source of the first transistor is connected to a first voltage terminal, and a gate of the first transistor is connected to a first terminal of the second storage capacitor;

a second terminal of the second storage capacitor is connected to a reference voltage terminal; a drain of the third transistor is connected to the gate of the driving transistor, the source of the third transistor is connected to the source of the driving transistor, and a gate of the third transistor is connected to a first scan signal line;

the resetting sub-circuit discharges the first storage capacitor and the second storage capacitor under the control of a first scan signal outputted from the first scan signal line;

the charging sub-circuit includes a fifth transistor and a sixth transistor, a source of the fifth transistor is connected to a data voltage input terminal, a drain of the fifth transistor is connected to a second terminal of the first storage capacitor, and a gate of the fifth transistor is connected to a second scan signal line; a gate of the sixth transistor is connected to a source of the sixth transistor, and a drain of the sixth transistor is connected to the first terminal of the second storage capacitor.

According to an embodiment of the present disclosure, the resetting sub-circuit includes a second transistor and a fourth transistor, a source of the second transistor is connected to the gate of the first transistor, a gate of the second transistor is connected to the first scan signal line; a source of the fourth transistor is connected to the second terminal of the first storage capacitor, a drain of the fourth transistor is connected to the reference voltage terminal, and a gate of the fourth transistor is connected to the first scan signal line.

According to an embodiment of the present disclosure, a drain of the second transistor is connected to the reference voltage terminal; as an alternative, a drain of the second transistor is connected to the source of the fourth transistor.

According to an embodiment of the present disclosure, a gate and a source of the sixth transistor are connected to the second scan signal line; as an alternative, a gate and a source of the sixth transistor are connected to the third scan signal line.

According to an embodiment of the present disclosure, the light emitting device is an organic light emitting diode.

According to an embodiment of the present disclosure, all of the driving transistor, the first transistor, the second transistor, the third transistor, the fourth transistor, the fifth transistor and the sixth transistor are N-type field effect transistors.

There is provided a method for driving the above-mentioned pixel circuit, characterized in that, the method includes steps of:

during a resetting phase, turning on the second transistor, the third transistor and the fourth transistor through the first scan signal line, such that electric charges stored in the second storage capacitor are released, electric charges stored in the first terminal of the first storage capacitor are released through the third transistor, the driving transistor and the light emitting device, and electric charges stored in the second terminal of the first storage capacitor are released through the fourth transistor;

during a compensating phase, turning off the second transistor, the third transistor and the fourth transistor through the first scan signal line, and turning on the fifth transistor through the second scan signal line, such that the first storage capacitor is charged by the data voltage input terminal through the fifth transistor, and turning on the sixth transistor through the second or a third scan signal line, such that the second storage capacitor is charged;

during a light emitting phase, turning off the second transistor, the third transistor and the fourth transistor through the first scan signal line, turning off the fifth transistor through the second scan signal line, and turning off the sixth transistor through the second or the third scan signal line, such that the first transistor is turned on by electric charges stored in the second storage capacitor, and the driving transistor is turned on by electric charges stored in the first storage capacitor to drive the light emitting device to emit light.

According to an embodiment, the method further includes:

during the resetting phase, turning off the first transistor by releasing electric charges stored in the first terminal of the second storage capacitor through the second transistor; or turning off the first transistor by releasing electric charges stored in the first terminal of the second storage capacitor through the second transistor and the fourth transistor.

Compared to the prior art, the embodiments of the present disclosure has the following advantages:

1. In the pixel circuit of the embodiments of the present disclosure, during process of compensating for the light emitting device, non-uniformity of driving transistors being n-type enhanced or depleted TFTs caused by threshold voltages of the driving transistors and an image sticking phenomenon caused by drifts of the threshold voltages of the driving transistors may be effectively eliminated through the compensation; and the problem of non-uniform luminance among the light emitting devices in different pixel units of an Active Matrix Organic Light Emitting Diode Display caused by different threshold voltages of the driving transistors in the different pixel units may be avoided. In addition, with the pixel circuit of the embodiments of the present disclosure, non-uniformity of electrical properties of the light emitting devices caused by non-uniform thickness of a mask during an evaporation process may be eliminated, and difference among driving currents for the respective light emitting devices in the Active Matrix Organic Light Emitting Diode Display caused by the non-uniformity of the light emitting devices may also be eliminated, thus improving a compensating effect of the pixel circuit on the light emitting device, and further improving performance of the Active Matrix Organic Light Emitting Diode Display.

2. In the embodiments of the present disclosure, a circuit configuration with a third scan signal line is proposed, thereby the sixth transistor for controlling the charging of the second storage capacitor and the fifth transistor for controlling the loading of the data voltage and the charging of the first storage capacitor may be scanned separately; that is, the charging process of the first storage capacitor and the charging process of the second storage capacitor which are originally performed simultaneously are now performed in two separate steps; such a purpose may be achieved that the first storage capacitor is pre-charged for a certain time, the second storage capacitor is then charged to turn on the first transistor, and thus the operating power supply for light-emitting is turned on. Since it takes a certain time for the storage capacitors to be charged and discharged, the problem of non-uniform and insufficient compensation caused by insufficient charging time for the first storage capacitor may be solved with such a configuration.

BRIEF DESCRIPTION OF THE DRAWINGS

The embodiments of the present disclosure will be described in detail with reference to accompanying drawings and embodiments.

DETAILED DESCRIPTION

Below, the technical solutions in the embodiments of the present disclosure will be described clearly and thoroughly with reference to the accompanying drawings of the embodiments of the present disclosure. Obviously, the embodiments as described are only some of the embodiments of the present disclosure, and are not all of the embodiments of the present disclosure. All other embodiments obtained by those skilled in the art based on the embodiments in the present disclosure without paying any inventive labor should fall into the protection scope of the present disclosure.

First Embodiment

Figure 1:
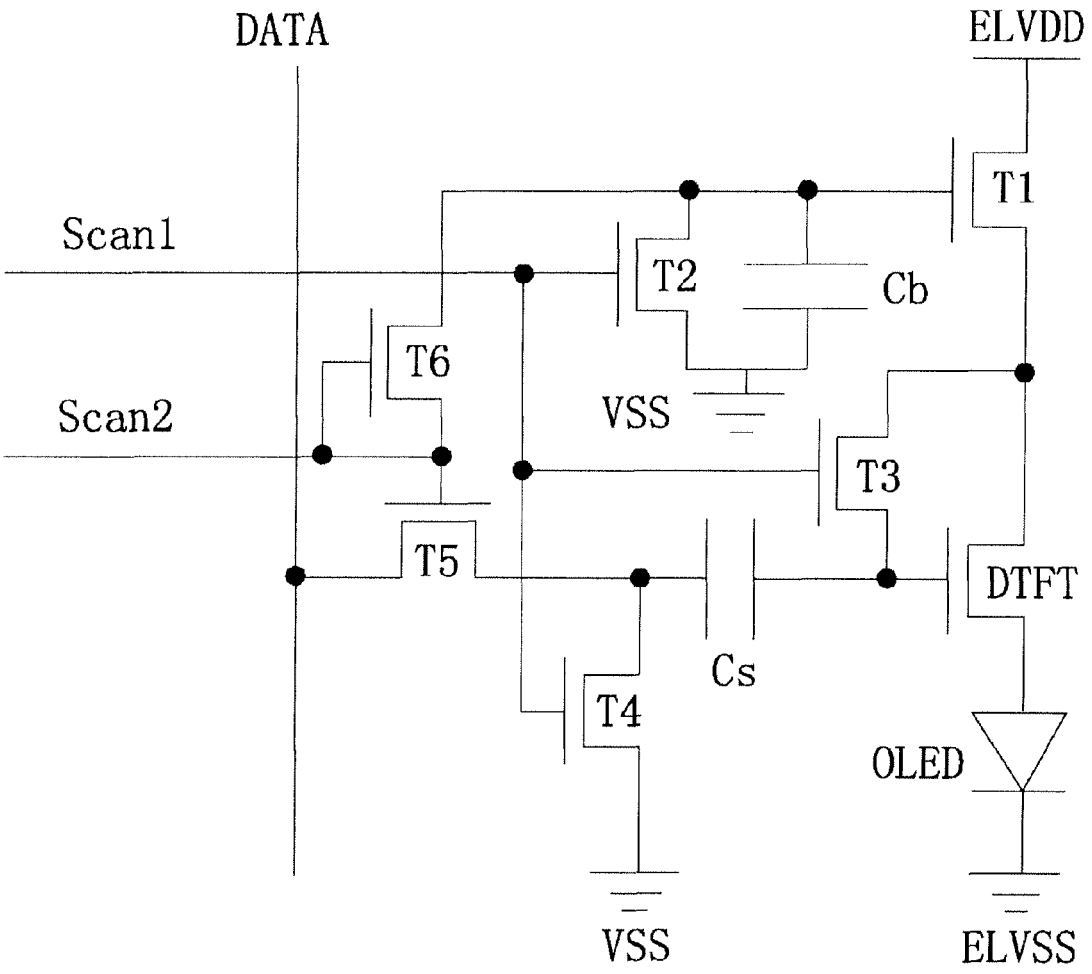
FIG. 1 is a schematic diagram of circuit configuration of a pixel circuit in a first embodiment of the present disclosure.

As shown in FIG. 1, a pixel circuit of the first embodiment of the present disclosure is mainly used for compensating for driving of respective light emitting devices in an Active Matrix Organic Light Emitting Diode Display, wherein driving of each of light emitting devices is compensated by one of pixel circuits, and each of pixel circuits includes a resetting sub-circuit, a charging sub-circuit, a driving sub-circuit and a light emitting device, wherein a first terminal of the light emitting device OLED is connected to a second voltage terminal ELVSS;

the driving sub-circuit includes a driving transistor DTFT, a first transistor T1, a third transistor T3, a first storage capacitor Cs and a second storage capacitor Cb, wherein a source of the driving transistor DTFT is connected to a drain of the first transistor T1 and a source of the third transistor T3, a drain of the driving transistor DTFT is connected to a second terminal of the light emitting device OLED, a gate of the driving transistor DTFT is connected to a first terminal of the first storage capacitor Cs; a source of the first transistor T1 is connected to a first voltage terminal ELVDD, and a gate of the first transistor T1 is connected to a first terminal of the second storage capacitor Cb;

a second terminal of the second storage capacitor Cb is connected to an import terminal VSS in reference voltage terminals; a drain of the third transistor T3 is connected to the gate of the driving transistor DTFT, the source of the third transistor T3 is connected to the source of the driving transistor DTFT, and a gate of the third transistor T3 is connected to a first scan signal line Scan1.

In the present embodiment, the resetting sub-circuit discharges the first storage capacitor Cs and the second storage capacitor Cb under the control of a first scan signal outputted from the first scan signal line Scan1.

In the present embodiment, the resetting sub-circuit includes a second transistor T2 and a fourth transistor T4, a source of the second transistor T2 is connected to the gate of the first transistor T1, a drain of the second transistor T2 is connected to the import terminal VSS in the reference voltage terminals, a gate of the second transistor T2 is connected to the first scan signal line Scan1; a source of the fourth transistor T4 is connected to a second terminal of the first storage capacitor Cs, a drain of the fourth transistor T4 is connected to the import terminal VSS in the reference voltage terminals, and a gate of the fourth transistor T4 is connected to the first scan signal line Scan1.

The charging sub-circuit includes a fifth transistor T5 and a sixth transistor T6, a source of the fifth transistor T5 is connected to a data voltage input terminal DATA, a drain of the fifth transistor T5 is connected to the source of the fourth transistor T4, and a gate of the fifth transistor T5 is connected to a second scan signal line Scan2; a gate and a source of the sixth transistor T6 are both connected to the second scan signal line Scan2, and a drain of the sixth transistor T6 is connected to the source of the second transistor T2.

Compared to traditional pixel structures, the pixel structure descried in the present embodiment may effectively solve the problems of drift and non-uniformity of threshold voltages of driving transistors being enhanced or depleted TFTs and those of voltage non-uniformity and aging of the light emitting devices.

The pixel circuit in the present embodiment is connected to an operating power supply (belongs to the prior art) for light emitting, which provides the first voltage terminal ELVDD and the second voltage terminal ELVSS for the pixel circuit. In the present embodiment, a voltage at the second voltage terminal ELVSS is usually selected in a range from −5V to 0V and may be obtained through actual adjustment. In the present embodiment, the light emitting device is an organic light emitting diode (OLED device).

In the pixel circuit of the present embodiment, during process of compensating for the light emitting device, non-uniformity of driving transistors being n-type enhanced or depleted TFTs due to threshold voltages of the driving transistors and an image sticking phenomenon due to drifts of the threshold voltages of the driving transistors may be effectively eliminated through the compensation; and the problem of luminance non-uniformity among the light emitting devices in different pixel units of an Active Matrix Organic Light Emitting Diode Display caused by different threshold voltages of the driving transistors in the different pixel units may be avoided. In addition, with the pixel circuit of the present embodiment, non-uniformity of electrical properties of the light emitting devices caused by non-uniform thickness of a mask during an evaporation process may be eliminated, and difference among driving currents for the respective light emitting devices in the Active Matrix Organic Light Emitting Diode Display caused by the non-uniformity of the light emitting devices may also be eliminated, thus improving a compensating effect of the pixel circuit for the light emitting device, and further improving quality of the Active Matrix Organic Light Emitting Diode Display.

In the present embodiment, the reference voltage terminals may include a plurality of import terminals VSS for being connected to the second terminal of the second storage capacitor Cb, the drain of the second transistor T2, the drain of the fourth transistor T4 and/or the second voltage terminal ELVSS. The reference voltage terminals are used for providing a reference potential for the above elements, for example, for being connected to a neutral line or an earth line to provide a zero potential or a negative voltage.

In the present embodiment, the driving transistor may be a driving transistor being an N-type TFT, and may particularly be an enhanced (with a positive threshold voltage) or depleted (with a negative threshold voltage) TFT; all of the driving transistor, the first transistor, the second transistor, the third transistor, the fourth transistor, the fifth transistor and the sixth transistor are field effect transistors.

Figure 2:
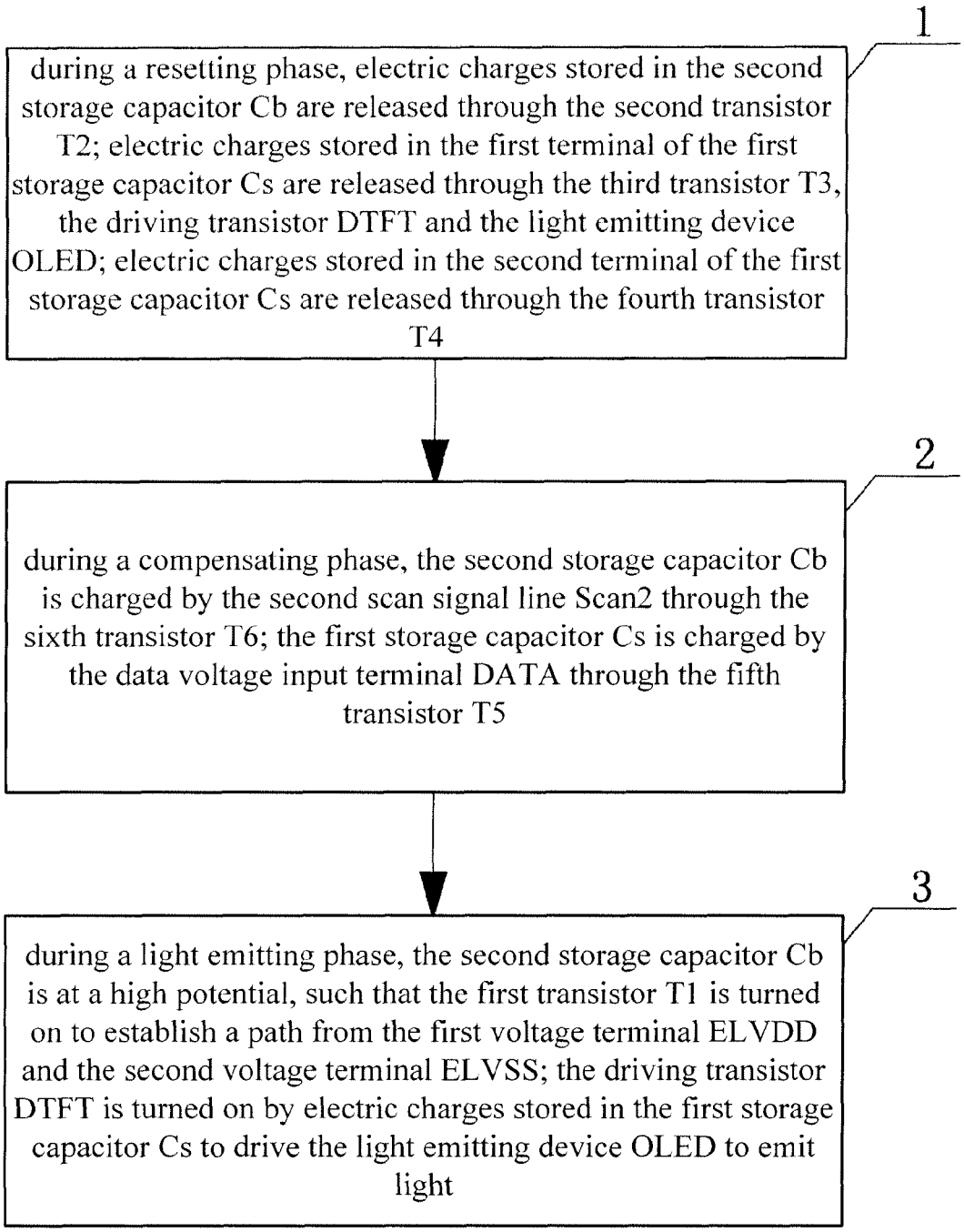
FIG. 2 is a flowchart of a method for driving the pixel circuit in the first embodiment of the present disclosure.
Figure 3:
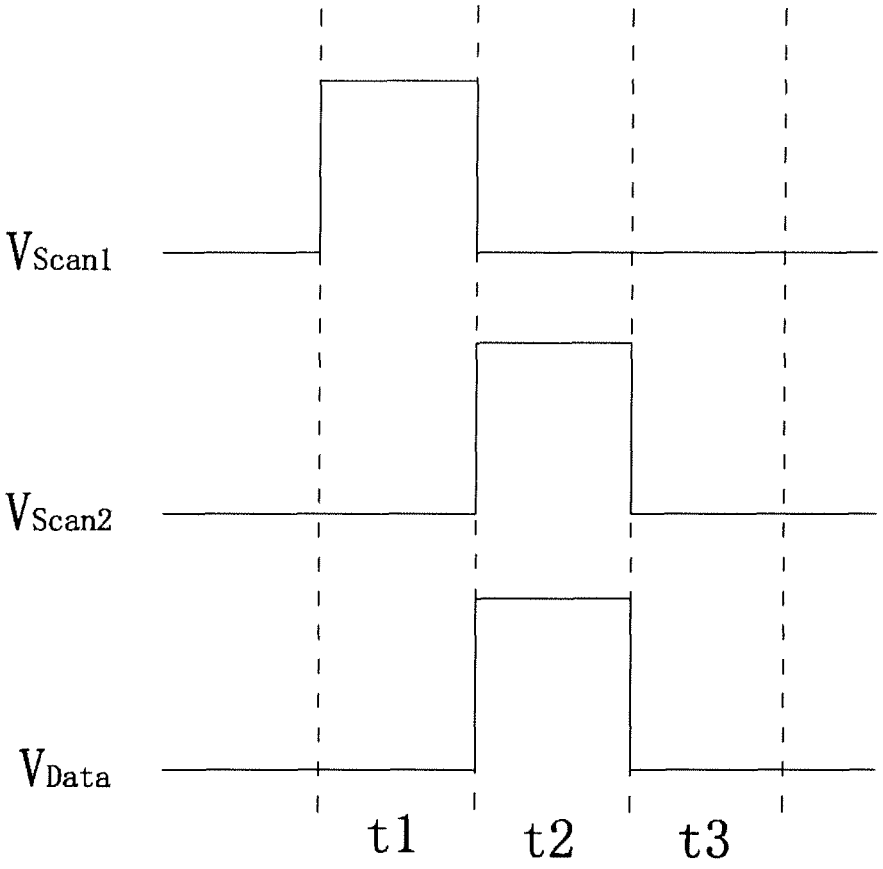
FIG. 3 is a schematic diagram of timing control of the method for driving the pixel circuit in the first embodiment of the present disclosure.

With reference to FIG. 2 and FIG. 3, in the present embodiment, there is further provided a method for driving the above-mentioned pixel circuit, the method includes a resetting phase, a compensating phase and a light emitting phase. These three phases will be described in detail with reference to FIG. 3, wherein $V_{Scan1}$ represents a potential waveform outputted from the first scan signal line Scan1, $V_{Scan2}$ represents a potential waveform outputted from the second scan signal line Scan2, $V_{Data}$ represents a potential waveform inputted from the data voltage input terminal DATA, t1 represents the resetting phase, t2 represents the compensating phase, and t3 represents the light emitting phase.

1. During the resetting phase, the first scan signal line Scan1 outputs a high potential, and the second scan signal line Scan2 outputs a low potential; the second transistor T2, the third transistor T3 and the fourth transistor T4 are turned on by the first scan signal line Scan1; the driving transistor DTFT is turned on by the third transistor T3; electric charges stored in the second storage capacitor Cb are released to the import terminal Vss in the reference voltage terminals through the second transistor T2, such that the first transistor T1 is turned off; electric charges stored in the first terminal of the first storage capacitor Cs are released to the second voltage terminal ELVSS through the third transistor T3, the driving transistor DTFT and the light emitting device OLED; meanwhile, electric charges stored in the second terminal of the first storage capacitor Cs are released to an import terminal Vss in the reference voltage terminals through the fourth transistor T4;

Once the electric charges in the first storage capacitor Cs and the second storage capacitor Cb are released completely, a voltage at the gate of the driving transistor DTFT is $V_{OLED}+V_{th}$, wherein $V_{OLED}$ is a voltage at the first terminal of the light emitting device OLED, and $V_{th}$ is the threshold voltage of the driving transistor DTFT. $V_{OLED}$ and $V_{th}$ are both constant values in the present embodiment.

2. During the compensating phase, the second scan signal line Scan2, outputs a high potential, and the first scan signal line Scan1 outputs a low potential; the second transistor T2, the third transistor T3 and the fourth transistor T4 are turned off by the first scan signal line Scant; the fifth transistor T5 and the sixth transistor T6 are turned on by the second scan signal line Scan2; the second storage capacitor Cb is charged by the second scan signal line Scan2 through the sixth transistor T6; meanwhile, the first storage capacitor Cs is charged by the data voltage input terminal DATA through the fifth transistor T5; the first terminal of the first storage capacitor Cs is raised to $V_{data}+V_{OLED}+V_{th}$, wherein $V_{data}$ is a data voltage and $V_{th}$ is the threshold voltage of the driving transistor DTFT; since a voltage at the first terminal of the first storage capacitor Cs is equal to the voltage at the gate of the driving transistor DTFT (referring to FIG. 1), the voltage at the gate of the driving transistor DTFT is also raised to $V_{data}+V_{OLED}+V_{th}$.

3. During the light emitting phase, the second scan signal line Scan2 and the first scan signal line Scan1 both output a low potential; the second transistor T2, the third transistor T3 and the fourth transistor T4 are turned off by the first scan signal line Scan1; the fifth transistor T5 and the sixth transistor T6 are turned off by the second scan signal line Scan2; the second storage capacitor Cb is at a high potential, such that the first transistor T1 is turned on meanwhile, the driving transistor DTFT is turned on by electric charges stored in the first storage capacitor Cs to drive the light emitting device OLED to emit light.

At this time, the voltage at the gate of the driving transistor DTFT is maintained to be $V_{data}+V_{OLED}+V_{th}$, a driving current inputted to the light emitting device OLED through the driving transistor DTFT can be represented by:

$$I_{OLED} = \frac{1}{2} \cdot \mu_n C_{OX} \cdot \frac{W}{L} \cdot [V_{DATA}, -V_{OLED} - V_{th} - ELVSS]^2$$

Wherein $\mu_n$ represents a carrier mobility, $C_{OX}$ represents a gate oxide layer capacitance of the first storage capacitor Cs, W/L represents a width/length ratio of a channel of the driving transistor DTFT, $V_{DATA}$, represents the voltage of the gate of the driving transistor DTFT, $V_{OLED}$ represents an operating voltage of the light emitting device OLED, ELVSS represents a voltage at the second voltage terminal. That is, $V_{DATA}=V_{data}+V_{OLED}+V_{th}$.

Substituting the above equation into the equation of the driving current $I_{OLED}$, the driving current $I_{OLED}$ inputted to the light emitting device OLED through the driving transistor DTFT becomes:

$$I_{OLED} = \frac{1}{2} \cdot \mu_n C_{OX} \cdot \frac{W}{L} \cdot [V_{data} + V_{OLED} + V_{th} - V_{OLED} - V_{th} - ELVSS]^2 = \frac{1}{2} \cdot \mu_n C_{OX} \cdot \frac{W}{L} \cdot [V_{data} - ELVSS]^2$$

From the above equation it can be known that the driving current $I_{OLED}$ flowing through the driving transistor DTFT merely has relation to $V_{data}$ and ELVSS, but has no relation to the threshold voltage $V_{th}$ of the driving transistor DTFT and the operating voltage for light emitting $V_{OLED}$ of the light emitting device OLED. Therefore, the compensation may be well done even if $V_{th}$ is less than 0, thus basically eliminating the effect of the non-uniformity and drift of the threshold voltages. With the pixel circuit of the present embodiment, no matter whether the enhanced TFTs or the depleted driving TFTs are adopted therein, the effect of the non-uniformity of the threshold voltages may be compensated, and thus the luminance non-uniformity of the light emitting devices may be well compensated. So the pixel circuit of the present embodiment may have a broader application scope.

Second Embodiment

A pixel circuit and method for driving the same in the second embodiment are improvements on the basis of those in the first embodiment, technical contents disclosed in the first embodiment are not repeated herein under a premise that the contents disclosed in the first embodiment also belong to contents disclosed in the second embodiment.

Figure 4:
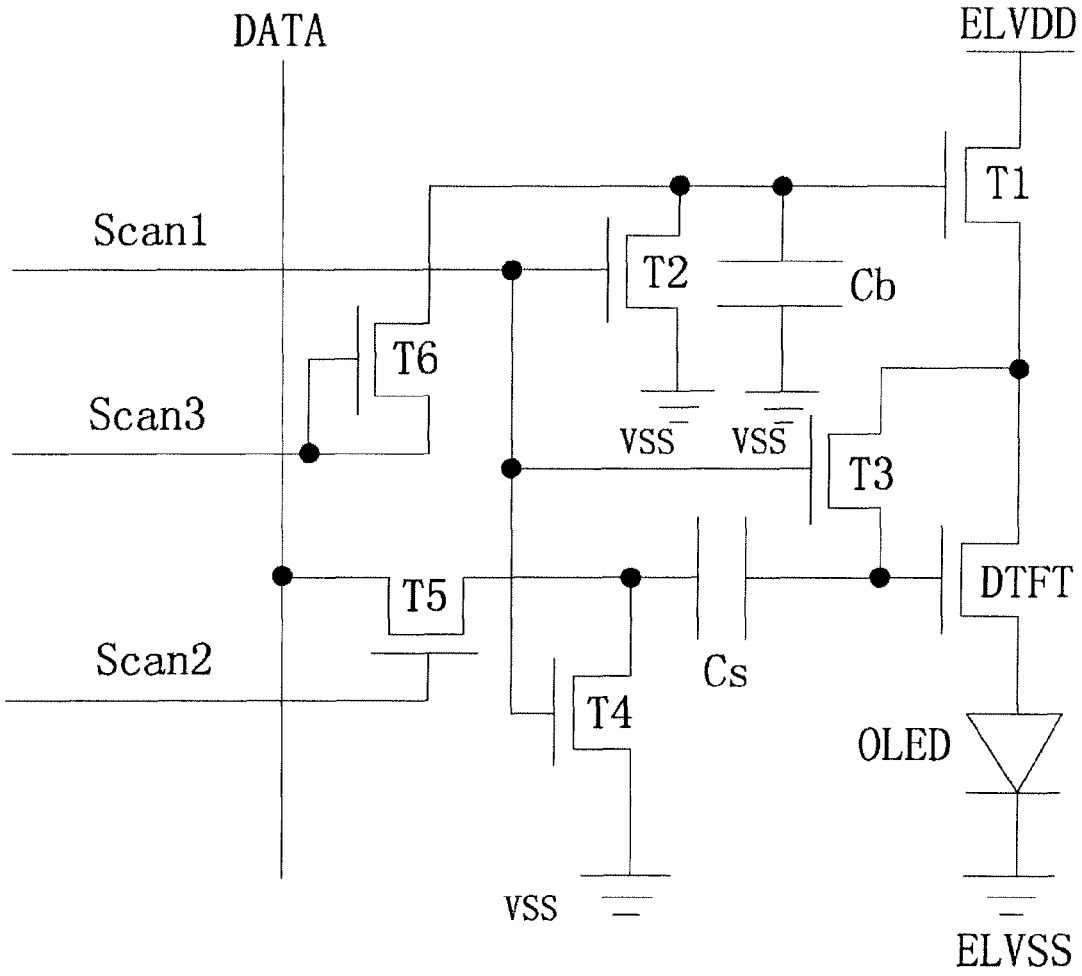
FIG. 4 is a schematic diagram of circuit configuration of a pixel circuit in a second embodiment of the present disclosure.

With reference to FIG. 4, as a variant of the technical solution in the first embodiment, the pixel circuit of the second embodiment further includes a third scan signal line Scan3. Particularly, the charging sub-circuit includes a fifth transistor T5 and a sixth transistor T6, wherein a source of the fifth transistor T5 is connected to a data voltage input terminal DATA, a drain of the fifth transistor T5 is connected to the source of the fourth transistor T4, and a gate of the fifth transistor T5 is connected to a second scan signal line Scan2; a gate and a source of the sixth transistor T6 are both connected to the third scan signal line Scan3, and a drain of the sixth transistor T6 is connected to the source of the second transistor T2.

With such a configuration, the sixth transistor T6 for controlling the charging of the second storage capacitor Cb and the fifth transistor T5 for controlling the loading of the data voltage and the charging of the first storage capacitor Cs may be scanned separately; that is, the charging process of the first storage capacitor Cs and the charging process of the second storage capacitor Cb which are originally performed simultaneously are now performed in two separate steps; such a purpose may be achieved that the first storage capacitor Cs is pre-charged for a certain time, the second storage capacitor Cb is then charged to turn on the first transistor, and thus the operating power supply for light-emitting is turned on. Since it takes a certain time for the storage capacitors to be charged or be released, the problem of non-uniform and insufficient compensation caused by insufficient charging time for the first storage capacitor Cs may be solved with such a configuration.

Figure 5:
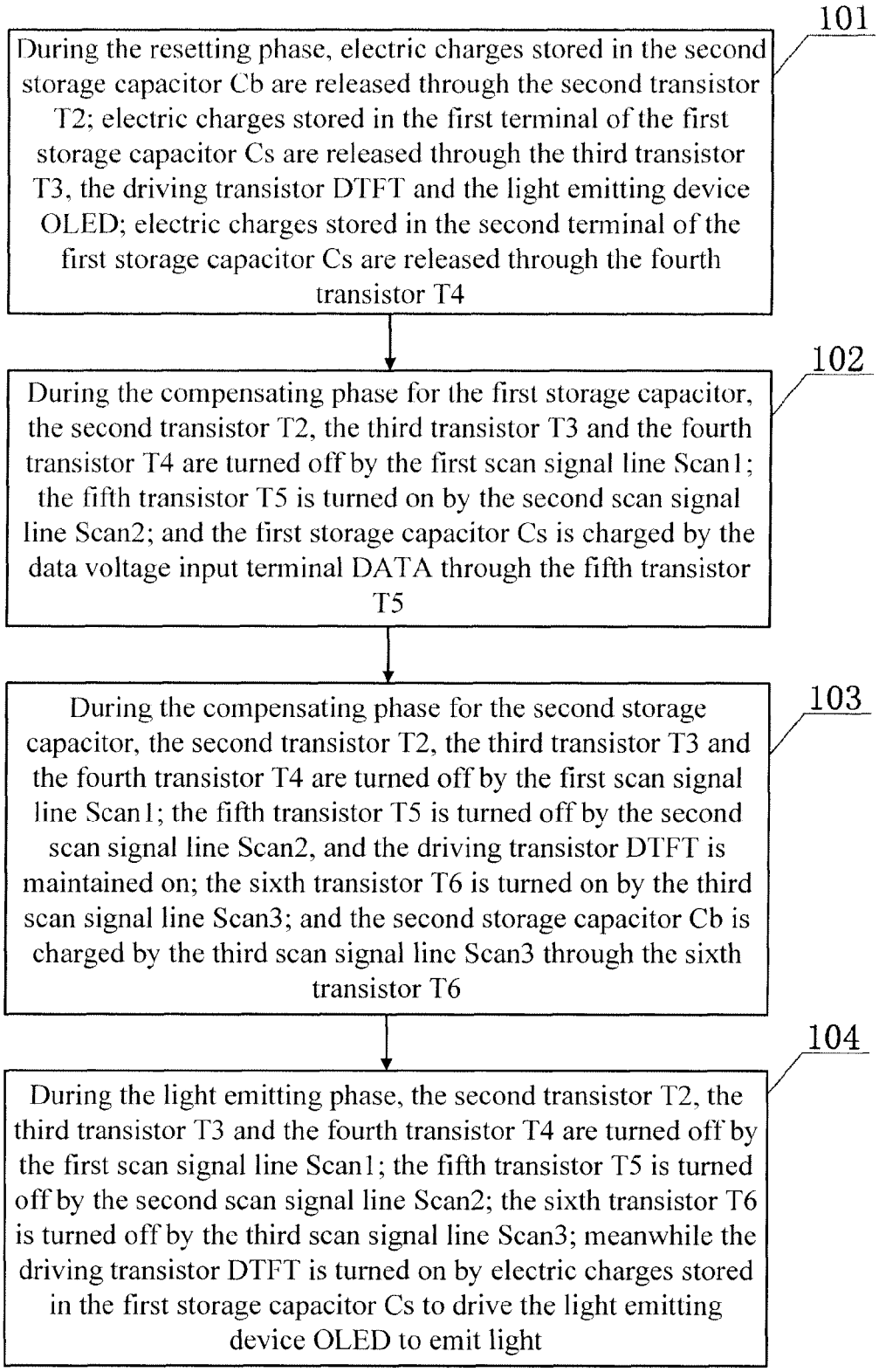
FIG. 5 is a flowchart of a method for driving the pixel circuit in the second embodiment of the present disclosure.
Figure 6:
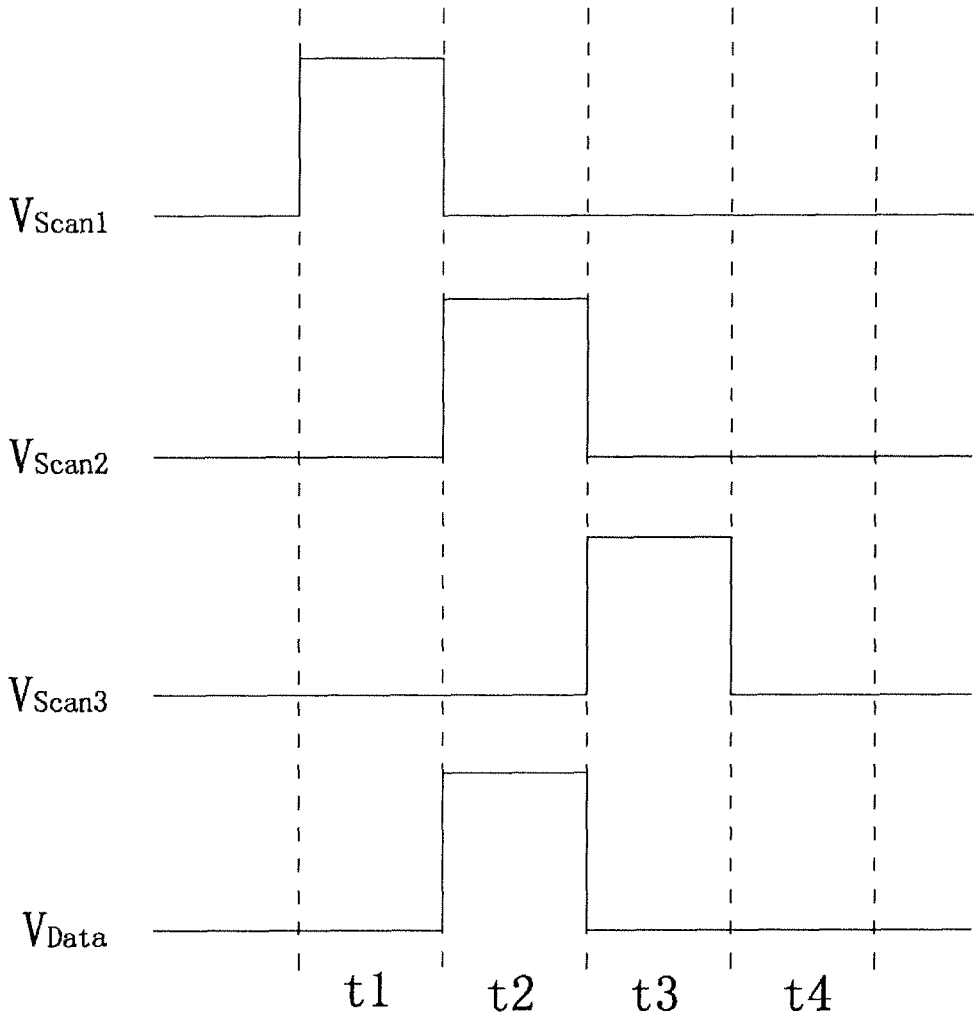
FIG. 6 is a schematic diagram of timing control of the method for driving the pixel circuit in the second embodiment of the present disclosure.

With reference to FIG. 5 and FIG. 6, the method for driving the above-mentioned pixel circuit in the present embodiment includes a resetting phase, a compensating phase and a light emitting phase, wherein the compensating phase further includes a compensating phase for the first storage capacitor and a compensating phase for the second storage capacitor. These four phases will be described in detail with reference to FIG. 6, wherein $V_{Scan1}$ represents a potential waveform outputted from the first scan signal line Scan1, $V_{Scan2}$ represents a potential waveform outputted from the second scan signal line Scan2, $V_{Scan3}$ represents a potential waveform outputted from the second scan signal line Scan3, $V_{Data}$ represents a potential waveform inputted from the data voltage input terminal DATA, t1 represents the resetting phase, t2 represents the compensating phase for the first capacitor, t3 represents the compensating phase for the second capacitor, and t4 represents the light emitting phase.

101. During the resetting phase, the first scan signal line Scan1 outputs a high potential, and meanwhile, the second scan signal line Scan2, and the third scan signal line Scan3 output a low potential; the second transistor T2, the third transistor T3 and the fourth transistor T4 are turned on by the first scan signal line Scan1; the driving transistor DTFT is turned on by the third transistor T3;

electric charges stored in the second storage capacitor Cb are released to an import terminal Vss in the reference voltage terminals through the second transistor T2, such that the first transistor T1 is turned off; electric charges stored in the first terminal of the first storage capacitor Cs are released to the second voltage terminal ELVSS through the third transistor T3, the driving transistor DTFT and the light emitting device OLED; electric charges stored in the second terminal of the first storage capacitor Cs are released to an import terminal Vss in the reference voltage terminals through the fourth transistor T4; once the electric charges in the first storage capacitor Cs and the second storage capacitor Cb are released completely, a voltage at the gate of the driving transistor DTFT is $V_{OLED}+V_{th}$, wherein $V_{OLED}$ is a voltage at the first terminal of the light emitting device OLED, and $V_{th}$ is the threshold voltage of the driving transistor DTFT. $V_{OLED}$ and $V_{th}$ are both constant values in the present embodiment.

102. During the compensating phase for the first storage capacitor, the second scan signal line Scan2 outputs a high potential, and the third scan signal line Scan3 and the first scan signal line Scan1 output a low potential; the second transistor T2, the third transistor T3 and the fourth transistor T4 are turned off by the first scan signal line Scan1; the fifth transistor T5 is turned on by the second scan signal line Scan2; and the first storage capacitor Cs is charged by the data voltage input terminal DATA through the fifth transistor T5;

At this time, a data voltage $V_{data}$ is loaded to the second terminal of the first storage capacitor Cs by the data voltage input terminal DATA, such that the first terminal of the first storage capacitor Cs is raised to $V_{data}+V_{OLED}+V_{th}$, wherein $V_{data}$ is the data voltage and $V_{th}$ is the threshold voltage of the driving transistor DTFT; since a voltage at the first terminal of the first storage capacitor Cs is equal to the voltage at the gate of the driving transistor DTFT (referring to FIG. 4), the voltage at the gate of the driving transistor DTFT is also raised to $V_{data}+V_{OLED}+V_{th}$. At this time, the second storage capacitor Cb is not charged since the sixth transistor T6 is turned off.

103. During the compensating phase for the second storage capacitor, the third scan signal line Scan3 outputs a high potential, and the second scan signal line Scan2 and the first scan signal line Scan1 output a low potential; the second transistor T2, the third transistor T3 and the fourth transistor T4 are turned off by the first scan signal line Scan1; the fifth transistor T5 is turned off by the second scan signal line Scan2, and the driving transistor DTFT is maintained on; the sixth transistor T6 is turned on by the third scan signal line Scan3; and the second storage capacitor Cb is charged by the third scan signal line Scan3 through the sixth transistor T6.

104. During the light emitting phase, all of the third scan signal line Scan3, the second scan signal line Scan2 and the first scan signal line Scan1 output a low potential; the second transistor T2, the third transistor T3 and the fourth transistor T4 are turned off by the first scan signal line Scan1; the fifth transistor T5 is turned off by the second scan signal line Scan2; the sixth transistor T6 is turned off by the third scan signal line Scan3; the first transistor T1 is turned on by the second storage capacitor Cb; meanwhile the driving transistor DTFT is turned on by electric charges stored in the first storage capacitor Cs to drive the light emitting device OLED to emit light.

At this time, the voltage at the gate of the driving transistor DTFT is maintained to be $V_{data}+V_{OLED}+V_{th}$, and the light emitting device OLED is driven by the driving transistor DTFT.

Third Embodiment

A pixel circuit and method for driving the same in the third embodiment are improvements on the basis of those in the second embodiment, technical contents disclosed in the second embodiment are not repeated herein under a premise that the contents disclosed in the second embodiment also belong to contents disclosed in the third embodiment.

Figure 7:
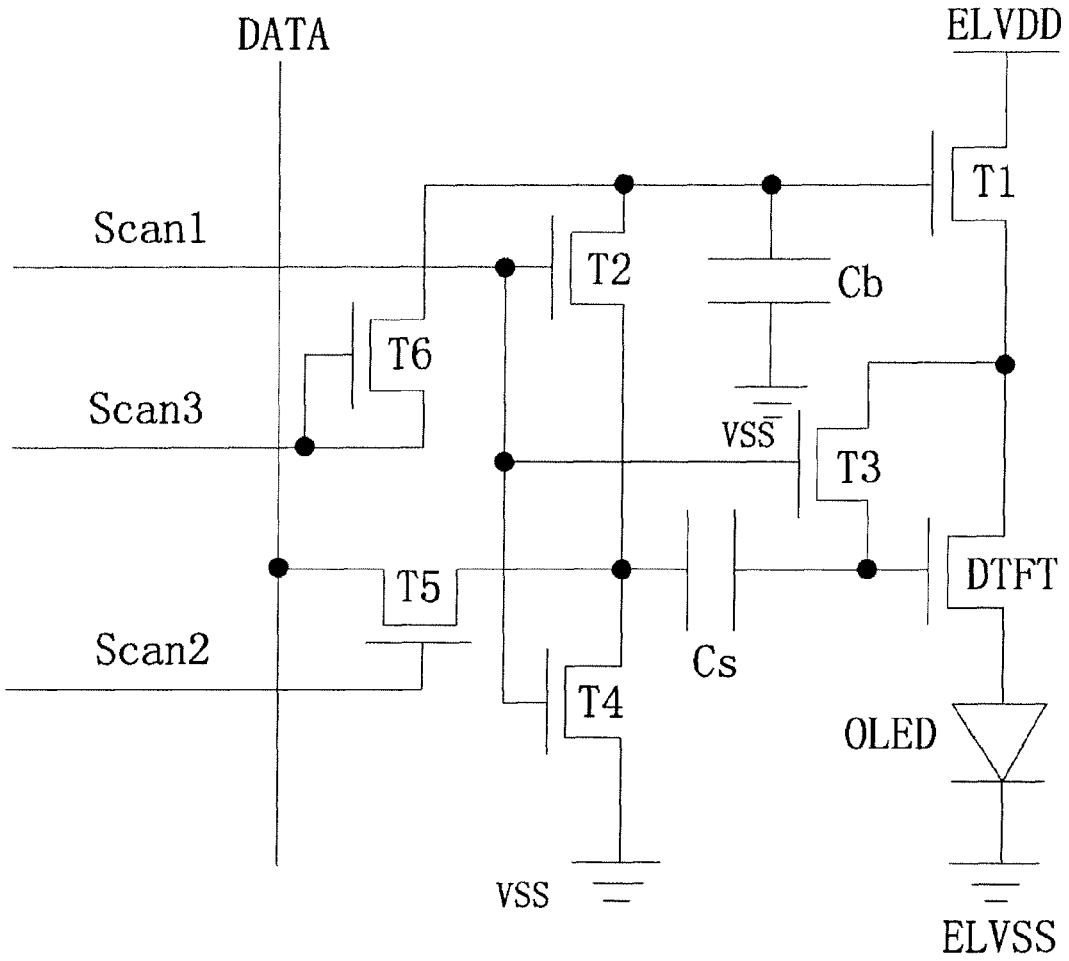
FIG. 7 is a schematic diagram of circuit configuration of a pixel circuit in a third embodiment of the present disclosure.

With reference to FIG. 7, as a variant of the technical solution in the second embodiment, the resetting sub-circuit further includes a second transistor T2 and a fourth transistor T4, wherein a source of the second transistor T2 is connected to the gate of the first transistor T1, a drain of the second transistor T2 is connected to a source of the fourth transistor T4, and a gate of the second transistor T2 is connected to the first scan signal line Scan1; the source of the fourth transistor T4 is connected to the second terminal of the first storage capacitor Cs, a drain of the fourth transistor T4 is connected to an import terminal VSS in the reference voltage terminals, and a gate of the fourth transistor T4 is connected to the first scan signal line Scan1. Thereby, the circuit configuration is simplified and cost thereof is saved.

Figure 8:
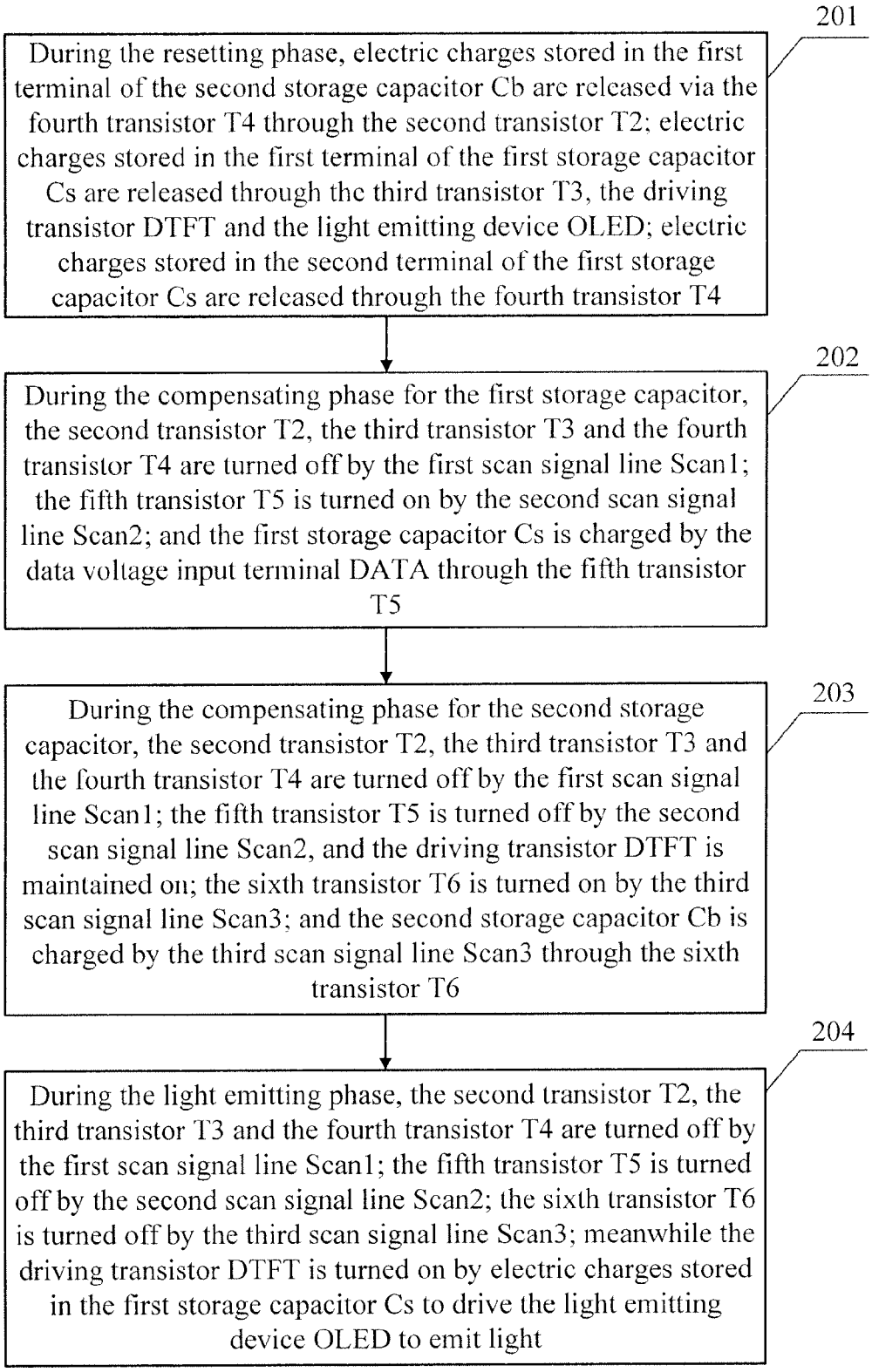
FIG. 8 is a flowchart of a method for driving the pixel circuit in the third embodiment of the present disclosure.
Figure 9:
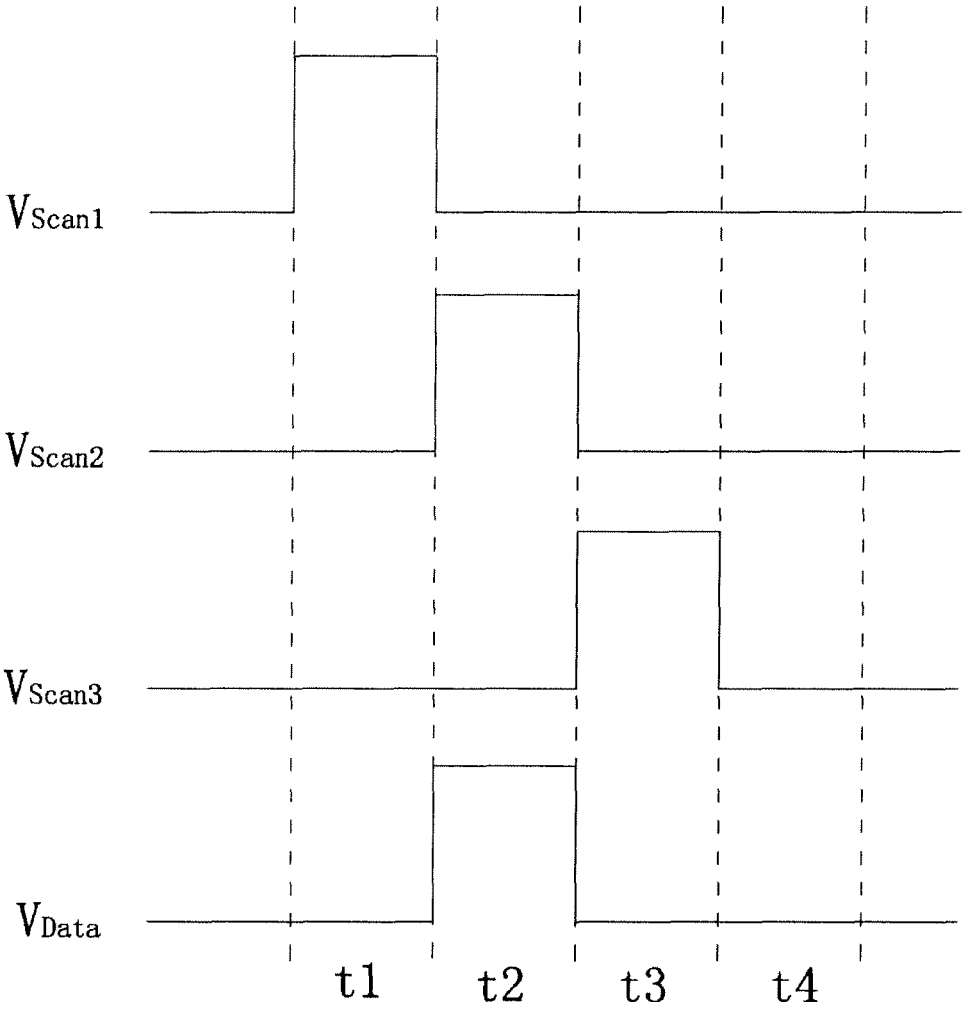
FIG. 9 is a schematic diagram of timing control of the method for driving the pixel circuit in the third embodiment of the present disclosure.

With reference to FIG. 8 and FIG. 9, the method for driving the above-mentioned pixel circuit in the present embodiment includes a resetting phase, a compensating phase and a light emitting phase, wherein the compensating phase further includes a compensating phase for the first storage capacitor and a compensating phase for the second storage capacitor. These four phases will be described in detail with reference to FIG. 9, wherein $V_{Scan1}$ represents a potential waveform outputted from the first scan signal line Scan1, $V_{Scan2}$ represents a potential waveform outputted from the second scan signal line Scan2, $V_{Scan3}$ represents a potential waveform outputted from the second scan signal line Scan3, $V_{Data}$ represents a potential waveform inputted from the data voltage input terminal DATA, t1 represents the resetting phase, t2 represents the compensating phase for the first capacitor, t3 represents the compensating phase for the second capacitor, and t4 represents the light emitting phase.

201. During the resetting phase, the first scan signal line Scan1 outputs a high potential, and meanwhile the second scan signal line Scan2, and the third scan signal line Scan3 output a low potential; the second transistor T2, the third transistor T3 and the fourth transistor T4 are turned on by the first scan signal line Scan1; the driving transistor DTFT is turned on by the third transistor T3;

electric charges stored in the first terminal of the second storage capacitor Cb are released to an import terminal Vss in the reference voltage terminals via the fourth transistor T4 through the second transistor T2, and electric charges stored in the second terminal of the second storage capacitor Cb are released to the import terminal Vss, such that the first transistor T1 is turned off; electric charges stored in the first terminal of the first storage capacitor Cs are released to the second voltage terminal ELVSS through the third transistor T3, the driving transistor DTFT and the light emitting device OLED; electric charges stored in the second terminal of the first storage capacitor Cs are released to the import terminal Vss in the reference voltage terminals through the fourth transistor T4; once the electric charges in the first storage capacitor Cs and the second storage capacitor Cb are released completely, a voltage at the gate of the driving transistor DTFT is $V_{OLED}+V_{th}$, wherein $V_{OLED}$ is a voltage at the first terminal of the light emitting device OLED, and $V_{th}$ is the threshold voltage of the driving transistor DTFT. $V_{OLED}$ and $V_{th}$ are both constant values in the present embodiment.

202. During the compensating phase for the first storage capacitor, the second scan signal line Scan2 outputs a high potential, and the third scan signal line Scan3 and the first scan signal line Scan1 output a low potential; the second transistor T2, the third transistor T3 and the fourth transistor T4 are turned off by the first scan signal line Scan1; the fifth transistor T5 is turned on by the second scan signal line Scan2; and the first storage capacitor Cs is charged by the data voltage input terminal DATA through the fifth transistor T5.

At this time, a data voltage $V_{data}$ is loaded to the second terminal of the first storage capacitor Cs by the data voltage input terminal DATA, such that the first terminal of the first storage capacitor Cs is raised to $V_{data}+V_{OLED}+V_{th}$, wherein $V_{data}$ is the data voltage and $V_{th}$ is the threshold voltage of the driving transistor DTFT; since a voltage at the first terminal of the first storage capacitor Cs is equal to the voltage at the gate of the driving transistor DTFT (referring to FIG. 7), the voltage at the gate of the driving transistor DTFT is also raised to $V_{data}+V_{OLED}+V_{th}$. At this time, the second storage capacitor Cb is not charged since the sixth transistor T6 is turned off.

203. During the compensating phase for the second storage capacitor, the third scan signal line Scan3 outputs a high potential, and the second scan signal line Scan2, and the first scan signal line Scan1 output a low potential; the second transistor T2, the third transistor T3 and the fourth transistor T4 are turned off by the first scan signal line Scan1; the fifth transistor T5 is turned off by the second scan signal line Scan2, and the driving transistor DTFT is maintained on; the sixth transistor T6 is turned on by the third scan signal line Scan3; and the second storage capacitor Cb is charged by the third scan signal line Scan1 through the sixth transistor T6.

204. During the light emitting phase, all of the third scan signal line Scan3, the second scan signal line Scan2 and the first scan signal line Scan1 output a low potential; the second transistor T2, the third transistor T3 and the fourth transistor T4 are turned off by the first scan signal line Scan1; the fifth transistor T5 is turned off by the second scan signal line Scan2; the sixth transistor T6 is turned off by the third scan signal line Scan3; the first transistor T1 is turned on by the second storage capacitor Cb; meanwhile the driving transistor DTFT is turned on by electric charges stored in the first storage capacitor Cs to drive the light emitting device OLED to emit light.

At this time, the voltage at the gate of the driving transistor DTFT is maintained to be $V_{data}+V_{OLED}+V_{th}$, and the light emitting device OLED is driven by the driving transistor DTFT.

It should be noted that sources and drains of all of transistors in the embodiments of the present disclosure are symmetric in structure, and thus may be interchanged to each other. In the embodiments of the present disclosure, in order to distinguish two electrodes other than a gate of a transistor, one is referred to as a source and the other is referred to as a drain. The drain may be used as a signal output terminal when the source is used as a signal input terminal, and vice versa.

The above descriptions are only for illustrating the embodiments of the present disclosure, and will make no limitation on the protection scope of the present disclosure. It will be obvious that modifications, variations and equivalences to the above embodiments made by those skilled in the art in the technical scope as disclosed in the embodiments of the present disclosure are intended to be included in the protection scope of the present disclosure. The protection scope of the present disclosure should be defined by the protection scope as claimed in the following claims.

What is claimed is:

1. A pixel circuit, comprising a resetting sub-circuit, a charging sub-circuit, a driving sub-circuit and a light emitting device, wherein a first terminal of the light emitting device is connected to a second voltage terminal;

the driving sub-circuit comprises a driving transistor, a first transistor, a third transistor, a first storage capacitor and a second storage capacitor, wherein a source of the driving transistor is connected to a drain of the first transistor and a source of the third transistor, a drain of the driving transistor is connected to a second terminal of the light emitting device, a gate of the driving transistor is connected to a first terminal of the first storage capacitor; a source of the first transistor is connected to a first voltage terminal, and a gate of the first transistor is connected to a first terminal of the second storage capacitor; a second terminal of the second storage capacitor is connected to a reference voltage terminal; a drain of the third transistor is connected to the gate of the driving transistor, the source of the third transistor is connected to the source of the driving transistor, and a gate of the third transistor is connected to a first scan signal line;

the resetting sub-circuit discharges the first storage capacitor and the second storage capacitor under a control of a first scan signal outputted from the first scan signal line;

the charging sub-circuit comprises a fifth transistor and a sixth transistor, a source of the fifth transistor is connected to a data voltage input terminal, a drain of the fifth transistor is connected to a second terminal of the first storage capacitor, and a gate of the fifth transistor is connected to a second scan signal line; a gate and a source of the sixth transistor are connected to the second scan signal line or connected to a third scan signal line, and a drain of the sixth transistor is connected to the first terminal of the second storage capacitor.

2. The pixel circuit of claim 1, wherein the resetting sub-circuit comprises a second transistor and a fourth transistor, a source of the second transistor is connected to the gate of the first transistor, a gate of the second transistor is connected to the first scan signal line; a source of the fourth transistor is connected to the second terminal of the first storage capacitor, a drain of the fourth transistor s connected to the reference voltage terminal, and a gate of the fourth transistor is connected to the first scan signal line.

3. The pixel circuit of claim 2, wherein a drain of the second transistor is connected to the reference voltage terminal; or a drain of the second transistor is connected to the source of the fourth transistor.

4. The pixel circuit of claim 2, wherein all of the driving transistor, the first transistor, the second transistor, the third transistor, the fourth transistor, the fifth transistor and the sixth transistor are N-type field effect transistors.

5. A method for driving the pixel circuit of claim 3, comprising:

during a resetting phase, turning on the second transistor, the third transistor and the fourth transistor through the first scan signal line, such that electric charges stored in the second storage capacitor are released, electric charges stored in the first terminal of the first storage capacitor are released through the third transistor, the driving transistor and the light emitting device, and electric charges stored in the second terminal of the first storage capacitor are released through the fourth transistor;

during a compensating phase, turning off the second transistor, the third transistor and the fourth transistor through the first scan signal line, and turning on the fifth transistor through the second scan signal line, such that the first storage capacitor is charged by the data voltage input terminal through the fifth transistor; and turning on the sixth transistor through the second or a third scan signal line, such that the second storage capacitor is charged;

during a light emitting phase, turning off the second transistor, the third transistor and the fourth transistor through the first scan signal line, turning off the fifth transistor through the second scan signal line, and turning off the sixth transistor through the second or the third scan signal line, such that the first transistor is turned on by electric charges stored in the second storage capacitor, and the driving transistor is turned on by electric charges stored in the first storage capacitor to drive the light emitting device to emit light.

6. The method of claim 5, wherein during the resetting phase, releasing electric charges stored in the first terminal of the second storage capacitor through the second transistor so that the first transistor is turned off; or releasing electric charges stored in the first terminal of the second storage capacitor through the second transistor and the fourth transistor so that the first transistor is turned off.

7. The pixel circuit of claim 1, wherein the light emitting device is an organic light emitting diode.

* * * * *